US006874437B2

(12) United States Patent
Kim

(10) Patent No.: US 6,874,437 B2
(45) Date of Patent: Apr. 5, 2005

(54) HEAD-CONTROL DEVICE AND ITS CONTROL METHOD FOR MULTI-HEAD EMBROIDERY MACHINE

(75) Inventor: Do Wan Kim, Inchon (KR)

(73) Assignee: Sunstar Precision Co., Ltd., Inchon (KR)

( * ) Notice: Subject to any disclaimer, the term of this patent is extended or adjusted under 35 U.S.C. 154(b) by 0 days.

(21) Appl. No.: 10/391,761

(22) Filed: Mar. 20, 2003

(65) Prior Publication Data

US 2003/0177971 A1 Sep. 25, 2003

(30) Foreign Application Priority Data

Mar. 20, 2002 (KR) ..... 10-2002-0015098

(51) Int. Cl.[7] ..... D05B 21/00

(52) U.S. Cl. ..... 112/102.5; 700/138

(58) Field of Search ..... 112/78, 470.06, 112/155, 102.5, 80.23, 80.43, 80.44, 475.19

(56) References Cited

U.S. PATENT DOCUMENTS 5,474,001 A * 12/1995 Tajima et al. ..... 112/102.5
6,173,665 B1 * 1/2001 Sekine ..... 112/102.5
6,698,369 B2 * 3/2004 Kwak ..... 112/102.5

* cited by examiner

*Primary Examiner*—John Calvert
*Assistant Examiner*—Brian Kauffman
(74) *Attorney, Agent, or Firm*—Staas & Halsey LLP.

(57) ABSTRACT

A head control device and its control method for a multi-head embroidery machine having a plurality of heads are disclosed. The present invention provides a head control device and its control method for a multi-head embroidery machine having a plurality of heads. The head control device comprises a central control unit controlling a whole system, the central control unit outputs a control signal for controlling a drive state of the respective head in response to an operation of an operator, so that the plurality of heads are selectively driven, and a embroidery task is performed by the selected head; and at least one head control unit for controlling the drive state of the respective head in response to the control signal from the central control unit.

5 Claims, 3 Drawing Sheets

HEAD-CONTROL DEVICE AND ITS CONTROL METHOD FOR MULTI-HEAD EMBROIDERY MACHINE

FIELD OF THE INVENTION

The present invention relates to a head control device and its control method for multi-head embroidery machine, and more particularly, a head control device and its control method for multi-head embroidery machine in which the corresponding control units are provided to individually control a plurality of heads, thereby facilitating a multi-colored embroidery task.

BACKGROUND OF THE INVENTION

In a conventional embroidery machine as shown in FIG. 1, a beam 102 at upper part of a work table 100 is provided between both end portions of the work table 100, and multiple heads having a plurality of needles are disposed along the beam 102 in identical interval.

Further, an upper shaft 106 for driving thread take-up levers (not shown) is provided in the lateral direction through the plurality of heads 104. A lower shaft 108 for rotating hooks (not shown) is provided in the lateral direction at lower part of the work table 100. The upper and lower shafts are supplied with power from a driving motor 110 disposed at lower part of one end portion of the work table 100 in order to drive the rotating hooks and needle bars for performing embroidery tasks.

Generally, each of the heads has nine needle bars, where one needle bar is intended to correspond to one color. Each of the heads is not driven with control of a central control unit, but each of the heads is typically driven with ON/OFF switch provided thereat. When an operator drives the switch, a head control signal is transferred to head control unit, and then the head is driven according to the control signal of the head control unit.

However, because such types of the conventional multi-head embroidery machines are limited in number of the needle bars provided at the heads as described above, the colors of embroidery available to one multi-head embroidery machine are limited in their number. As a result, only 9 to 12 colors have been used in the related industry. However, it is a problem that the limitation of the colors can not provide enough colors to attain multi-colored embroidery design required by operators.

To solve the problem, products of embroidery machines that have more numbers of the needle bars provided at one head have been proposed. However, in the proposed products, the size of the heads is too increased to effectively operate the embroidery machine. And also, the proposed products have other problems to increase cost of manufacturing the embroidery machine.

Further, in case of requiring a wide range of embroidery, the embroidery task have to be performed beyond the range of the adjacent heads, so that the adjacent heads are forced to be stopped for the purpose of performing a desired embroidery task. As a result, in this case, the operator has to directly operate the ON/OFF switch to stop the drive of the adjacent heads for the purpose of performing the desired embroidery task. It is inconvenient that after the desired embroidery task, the operator has to drive the stopped heads again using the switch for the purpose of performing the next embroidery task.

SUMMARY OF THE INVENTION

The present invention is provided to solve the above-mentioned problems. An object of the present invention is to provide a device and a method for controlling a plurality of heads so that it is possible to get rid of any inconvenience that operators have to directly drive of a specific head.

An another object of the present invention is to provide a device and a method for controlling a plurality of heads so that it is possible to provide as many numbers of colors as desired for multi-colored embroidery design while using the conventional head itself.

To achieve the above and other objects of the present invention, there is provided a head control device for a multi-head embroidery machine having a plurality of heads, comprising: a central control unit controlling a whole system, the central control unit outputs a control signal for controlling a drive state of the respective head in response to an operation of an operator, so that the plurality of heads are selectively driven, and a embroidery task is performed by the selected head; and at least one head control unit for controlling the drive state of the respective head in response to the control signal from the central control unit.

It is preferred that the central control unit comprises: a setting means for inputting the head group information for grouping the adjacent heads to perform the embroidery task and the head driving information for setting the drive state of respective head; a processor for outputting the control signal for driving the head control unit in response to the control information input to the setting means; and a storage mean for storing the head group information and the head driving information input by the setting means in response to the control signal of the processor.

It is also preferred that the respective head control unit is commonly connected to the grouped heads, thereby controlling simultaneously the heads in response to the control signal from the central control unit.

To achieve the above and other objects of the present invention, there is provided a method for controlling the heads for a multi-head embroidery machine having a plurality of heads, comprising steps of: (a) inputting a head group information for grouping adjacent heads to perform an embroidery task in response to operation of the operator, and storing the head group information; (b) inputting a head driving information for setting a drive state of respective head in response to operation of the operator, storing the head driving information, and outputting a head control signal according to the head driving information and (c) selectively controlling the head according to the head control signal.

It is preferred that the method further comprises step of controlling simultaneously the plurality of heads disposed in adjacent positions.

It is also preferred that the step (b) comprises steps of: (b-1) obtaining 'n' that satisfies $(n-1)*a<b\leqq n*a$ when the control information input by the operator comprises information for driving b-th needle bar of the respective head, wherein 'n' represents the number of heads consisting of the head group, 'a' represents the number of needle bars provided at the respective head, and 'b' represents the needle bar to be operated by the head control signal; (b-2) creating head driving information for simultaneously driving $\{b-(n-1)*a\}$-th needle bar of n-th head in the respective head group according to the 'n' obtained in the step (b-1).

BRIEF DESCRIPTION OF THE DRAWINGS

The above and other objects, advantages and features of the present invention will become apparent from the following description of preferred embodiments given in conjunction with the accompanying drawings, in which.

DETAILED DESCRIPTION OF THE PREFERRED EMBODIMENTS

The preferred embodiments according to the present invention will be now described in detail with reference to the accompanying drawings.

Figure 1:
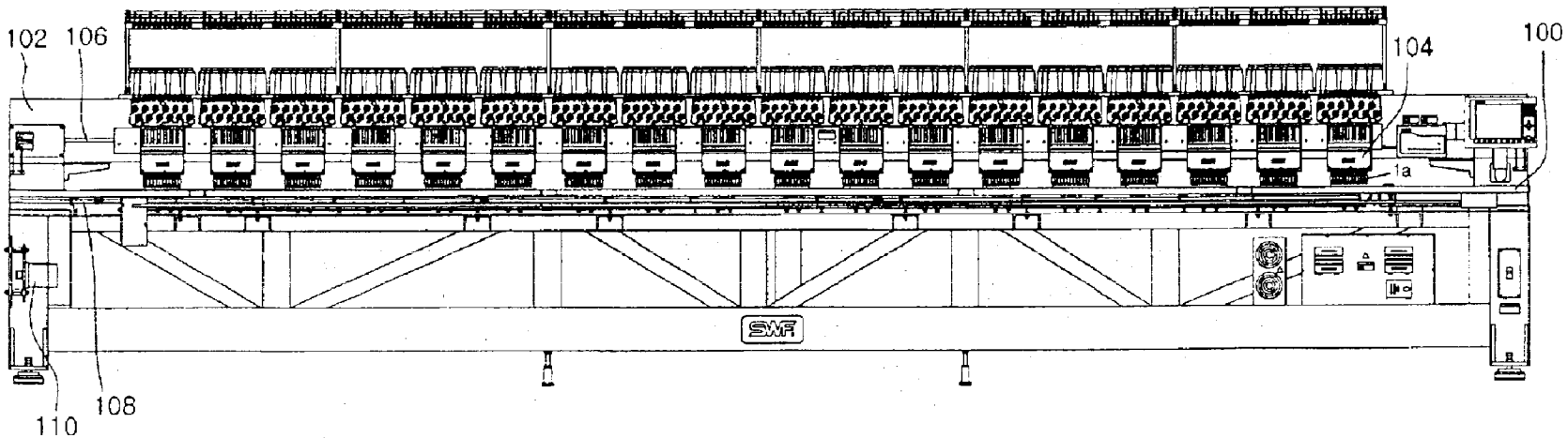
FIG. 1 PRIOR ART
FIG. 1 is an elevation view illustrating a whole exterior of a conventional multi-head embroidery machine.
Figure 2:
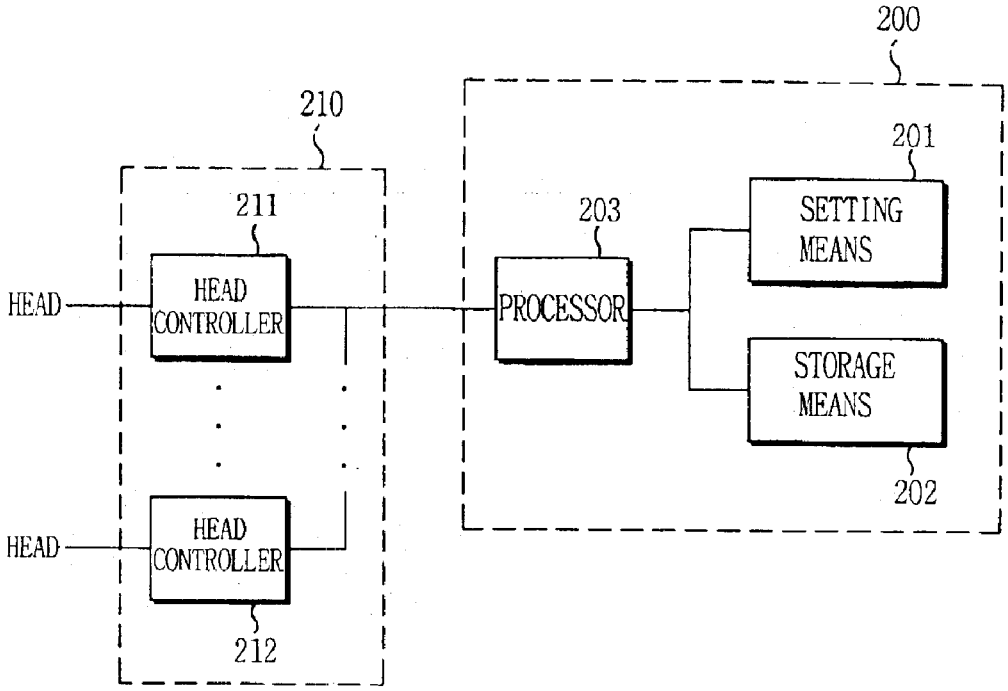
FIG. 2 is a block diagram illustrating a head control device of a multi-head embroidery machine according to an embodiment of the present invention.

FIG. 2 is a block diagram illustrating a head control device of a multi-head embroidery machine according to the present invention. The control device comprises a central control unit 200 and a head control unit 210. The central control unit 200 comprises a setting means 201 for inputting the head group information for grouping the adjacent heads to perform the embroidery task and the head driving information for setting the drive state of respective head; a processor 203 for outputting the control signal for driving the head control unit in response to the control information input to the setting means 201; and a storage means 202 for storing the head group information and the head driving information input by the setting means 201 in response to the control signal of the processor 203.

Information input by the setting means 201 may further include any data necessary for the embroidery task besides the head group information and the head driving information. The setting means 201 refers to a means for receiving the information necessary for the embroidery task and sending the information to the processor 203. The storage means 202 refers to a means for storing the information, for example, such as a semiconductor memory, magnetic drum or the like.

The head control unit 210 comprises a plurality of head controllers 211 and 212. The respective controller 211 or 212 controls a position where the corresponding head performs the embroidery task and whether the head is made to be driven or not, and also directly controls needle bars provided at the head. The central control unit 200 processes the information necessary for each of the head controllers 211 and 212 through above mentioned the setting means 201, the storage means 202 and the processor 203, and then transfer the control information to each of the head controllers 211 and 212.

A plurality of the head controllers 211 and 212 connected to the central control unit 200 are connected to the corresponding head. Alternatively, the head controllers 211 and 212 may be constructed to commonly control a group of heads consisting of multiple heads.

Figure 3:
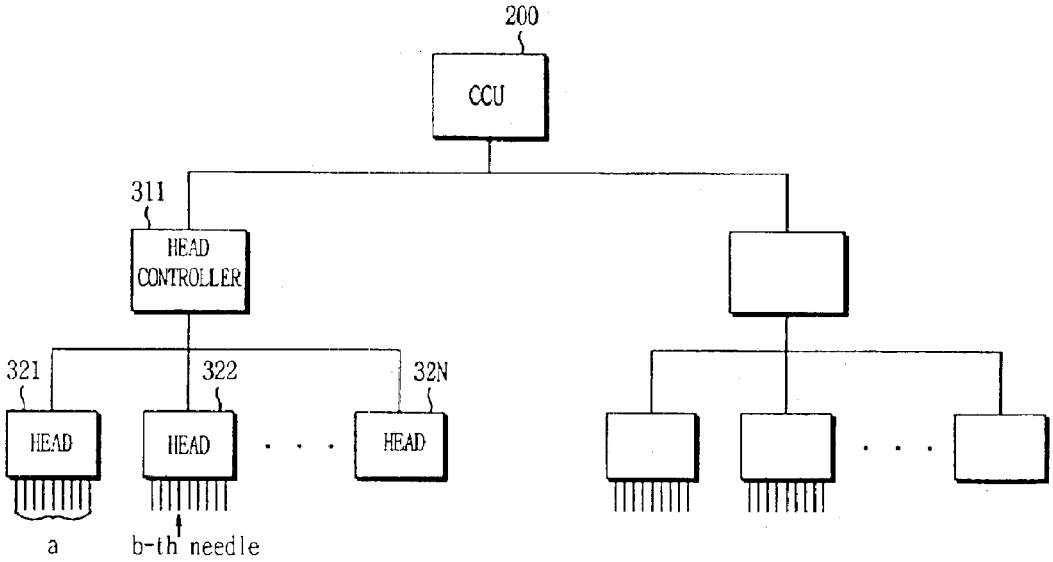
FIG. 3 is a block diagram illustrating the connection relation between control units and heads of a multi-head embroidery machine according to an embodiment of the present invention.

An example of a case where multiple heads are classified into one group of heads and the head group is commonly controlled by one head controller will be described in FIG. 3. As shown in FIG. 3. all N heads 321, 322, . . . , 32N belonging to one group of heads are commonly controlled by one head controller 311. In other-wards, one head controller 311 identifies one group of heads consisting of N heads 321, 322, . . . , 32N as 'one head'. In addition, assuming that the number of the needle bars provided to each of the heads 321, 322, . . . , 32N is 'a', the head controller 311 identifies the needle bars of the first head 321 as 1st, 2nd, 3rd, . . . , a-th needle barn and the needle bars of the second head 322 as (a+1)-th, (a+2)-th, (a+3)-th, . . . , 2a-th needle bars. Similarly, the remaining needle bars are identified in the above mentioned manner.

Therefore, in above mentioned manner, the head controller 311 identifies and controls a plurality of heads as one head so that it is possible to use the conventional heads without any increase of the number of the needle bars provided at one head, thereby making use of more colors to the embroidery task.

Figure 4:
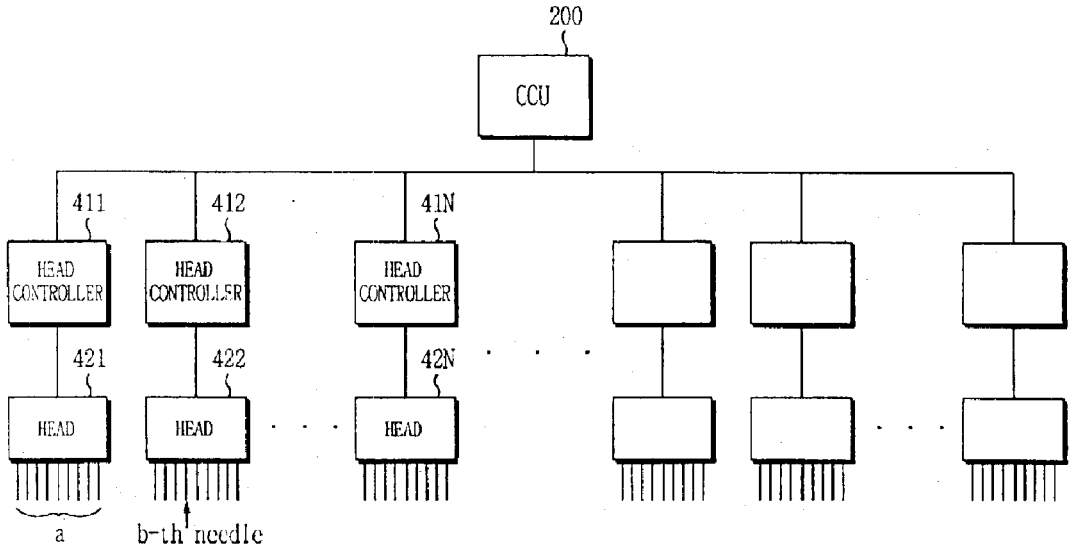
FIG. 4 is a block diagram illustrating the connection relation between control units and heads of a multi-head embroidery machine according to another embodiment of the present invention.

Another embodiment according to the present invention is illustrated in FIG. 4. As shown in FIG. 4, a plurality of head controller 411, 412, . . . are provided corresponding to the number of the heads. Each of the head controllers is connected to the corresponding heads 421, 422, . . . , and individually controls the corresponding head.

One head controller controls one head, and the control information for controlling the needle bars used in the embroidery task is commonly transferred to all the head controllers 411, 412, . . . . However the control information whether the head is made to be driven or not is individually transferred to each of the head controllers 411, 412, . . . .

In the conventional multi-head embroidery machines, operators have directly operated the ON/OFF switch provided at each of the heads to drive each of the heads, but in the multi-head embroidery machine according to the present invention, the central control unit 200 transfers the control information for controlling the drive of each of the heads 421, 422, . . . to the head controllers 411, 412, . . . , so that each of the head controllers 411, 412, . . . can directly control, that is, ON/OFF of each of the heads 421, 422, . . . .

Since the central control unit itself instead of operators can directly drive each of the heads, it is possible to perform various types of the embroidery tasks, which have not been available in the conventional multi-head embroidery machines.

To this end, the central control unit 200 comprises the setting means 201 and the storage means 202. In case that a range of one embroidery task that the multi-head embroidery machine has to perform is wider than a normal range of the embroidery task, for example, that one head have to perform embroidery task across a range of two heads, the embroidery task can not be performed if the adjacent heads are not stopped.

In case of using the conventional multi-head embroidery machine, an operator must directly stop the drive of the 2nd, 4-th, . . . heads 422, 424, . . . using ON/OFF switch provided at each of the heads, and then perform the embroidery tasks of the 1st, 3rd, . . . heads 421, 423, . . . . Further, for the purpose of performing any different embroidery tasks, the operators must directly operate the drive-stopped heads again using ON/OFF switch.

However, according to the present invention, operators only set the control information associated with the drive of the head through the setting means 201, and the control information is processed by the processor 203 to be stored in the storage means 202 so that it is possible to smoothly perform the embroidery task having such a wide range above mentioned without any operation of the operators. In other words, although the information for the needle bars used in the embroidery task is transferred to all the head, during the embroidery task, only the 1st, 3rd, . . . heads 421, 423, . . . are driven and the embroidery task can not be performed up to the range of the 2nd, 4th, . . . heads 422, 424, . . . .

In addition, according to the present invention, the head controllers can directly control the drive of each of the heads so that it is possible to provide more embroidery colors while using the heads having the same number of the needle bars as the conventional ones. As shown in FIG. 4, it is assumed that the number 'a' of the needle bars provided at each of the heads 421, 422, . . . is equal to 9 like the conventional embroidery machine, one group of heads consists of three heads (that is, N=3), and the needle bar 'b' desired to perform the embroidery task is the 13-th needle bar, which corresponds to the case of performing an embroidery task with the 13-th color). Because it is the embroidery task of the multi-head embroidery machine, each of the head groups (for example, the three heads 421, 422, and 423 form one group of heads) performs the same embroidery task.

As described above, since one needle bar is intended to be used for one color of embroidery, the colors of the embroidery available in the conventional multi-head embroidery machine is limited to 9 colors. In other words, since 13>9 (that is, b>a), the desired colors of embroidery are beyond the range of 9 colors of embroidery provided at the one head (the number of the needle bars provided at the one head is equal to 9), so that it is impossible to achieve the embroidery task with the desired color using the conventional multi-head embroidery machine.

In this case, according to the present invention, the central control unit 200 calculates inequality of $(n-1)*a<b\leqq n*a$ (n=1, 2, . . . , N) to obtain n=2 which satisfies $(n-1)*9<13\leqq n*9$. Because of n=2, the central control unit 200 drives only the 2nd head and, at the same time, stops the other heads, that is, the 1st and 3rd heads. Further, the central control unit 200 creates the control information for performing the embroidery task using the 4th needle bar which satisfies $\{b-(n-1)*a\}$ of the 2nd head (that is, $13-(2-1)*9=4$).

Alternatively, the control information may be set to control information directly obtained by calculation of operators without using the processor 203 of the central control unit 200. Although the control information for performing the embroidery task with the 4th needle bar is commonly transferred to all the head controllers 411, 412, . . . , the control information for driving the heads themselves is transferred only to the 2nd heads 422, . . . in each of the head groups (to the remaining head controllers, the control information for stopping the drive of the heads is transferred), so that each of the head groups can perform the embroidery task using the 4th needle of the 2nd head.

Therefore, if only the position of the embroidery task to be performed is adjusted, which is also calculated by the central control unit 200, it is possible to perform the embroidery task with providing more numbers of needle bars, that is, embroidery colors than that of needle bars provided at one head while using the heads having the same number of the needle bars as the conventional ones. For example, in the above mentioned embodiment, one group of heads is assumed to consist of three heads and one head is assumed to have nine needle bars, so that it is possible to make use of 27 colors.

The embodiments described above are not for limiting the range of the present invention, and the present invention may further comprise modifications that can be made by the skilled in the art without the spirit of the present invention within the scope of the claims.

As above described, the present invention can provide a device and a method for controlling a plurality of heads so that it is possible to get rid of any inconvenience that operators have to directly operate the drive of the specific head.

Further, the present invention can provide a device and a method for controlling a plurality of heads so that it is possible to provide as many numbers of colors as desired for multi-colored embroidery design while using the conventional head itself.

What is claimed is:

1. A head control device for a multi-head embroidery machine having a plurality of heads, comprising:

a central control unit outputting a control signal for controlling a drive state of a respective head in response to an operation of an operator, so that the plurality of heads are selectively driven, and an embroidery task is performed by the selectively driven heads;

at least one head control unit for controlling the drive state of the respective head in response to the control signal from the central control unit, wherein the central control unit comprises:

a setting unit for inputting a head group information for grouping adjacent heeds to perform the embroidery task, a head driving information setting the drive state of the respective head, and data necessary for the embroidery task, and for sending the head group information, head driving information, and data necessary for the embroidery task to a processor;

the processor for outputting the control signal for driving a respective head control unit in response to control information input to the setting unit, and a storage unit for storing the head group information, the head driving information, and the data necessary for the embroidery task, input by the setting unit, in response to the control signal of the processor; and wherein the respective head control unit is commonly connected to grouped heads, thereby controlling simultaneously the grouped heads in response to the control signal from the central control unit to coordinate adjacent grouped heads to synthesize an operation of a single head with selective operation of the adjacent grouped heads.

2. The head control device of claim 1, wherein the head driving information controls simultaneously driving a $\{b-(n-1)*a\}$-th needle bar of an n-th head in a respective head group.

3. The head control device of claim 1, wherein the embroidery task is performed based on adjacent heads being linked into one group.

4. A method for controlling a multi-head, embroidery machine having a plurality of heads, comprising:

inputting head group information grouping adjacent heads to perform an embroidery task in response to an operation of an operator, and storing the head group information:

inputting head driving information setting a drive state of a respective head in response to the operation of the operator, storing the head driving information, and outputting a head control signal according to the head driving information; and selectively controlling at least one of the plurality of heads according to the head control signal, wherein the inputting of the head driving information comprises:

obtaining 'n', satisfying $(n-1)*a<b=n*a$, when control information input by the operator comprises information for driving a b-th needle bar of the respective head, wherein 'n' represents a number of heads making up a head group, 'a' represents a number of needle bars provided at the respective head, and 'b' represents a needle bar to be operated by the head control signal, and creating driving information for simultaneously driving a $\{b-(n-1*a\}$-th needle bar of an n-th head in a respective head group.

5. The method of claim 4, wherein the method further comprises controlling simultaneously a plurality of adjacent heads.

* * * * *